US005738822A

United States Patent [19]

Lonardi et al.

[11] Patent Number: 5,738,822

[45] Date of Patent: Apr. 14, 1998

[54] SHAFT FURNACE CHARGING DEVICE WITH ROTATING CHUTE

[75] Inventors: Emile Lonardi, Bascharage; Guy Thillen, Diekirch; Georges Reuter, Ettelbrück, all of Luxembourg

[73] Assignee: Paul Wurth S.A., Luxembourg

[21] Appl. No.: 750,358

[22] PCT Filed: May 5, 1995

[86] PCT No.: PCT/EP95/01704

§ 371 Date: Feb. 26, 1997

§ 102(e) Date: Feb. 26, 1997

[87] PCT Pub. No.: WO95/33858

PCT Pub. Date: Dec. 14, 1995

[30] Foreign Application Priority Data

Jun. 8, 1994 [LU] Luxembourg ..... 88494

[51] Int. Cl.[6] ..... C21B 7/08

[52] U.S. Cl. ..... 266/199; 266/184

[58] Field of Search ..... 266/199, 197, 266/184; 414/202, 206, 208

[56] References Cited

U.S. PATENT DOCUMENTS

| | | | |
|---|---|---|---|
| 3,533,523 | 10/1970 | Schneider | 266/184 |
| 3,693,812 | 9/1972 | Mahr et al. | 266/199 |
| 4,071,166 | 1/1978 | Legille et al. | 414/202 |
| 4,512,702 | 4/1985 | Mailliet et al. | 414/202 |
| 4,728,240 | 3/1988 | Mahr et al. | 266/184 |
| 4,941,792 | 7/1990 | Cimenti et al. | 414/208 |
| 5,022,806 | 6/1991 | Lonardi et al. | 414/208 |
| 5,299,900 | 4/1994 | Mailliet et al. | 266/199 |

*Primary Examiner*—Scott Kastler
*Attorney, Agent, or Firm*—Gary M. Nath; Nath & Associates

[57] ABSTRACT

A shaft furnace charging device with rotating chute comprises a supporting structure (22) overhanging the shaft furnace (10), a mounting flange (18) fixed rigidly to the shaft furnace (10), a batch hopper (26, 28) supported by the supporting structure (22), a drive housing (30) for the chute (32) which is connected in a sealed manner at one end to the batch hopper (26, 28) and at the other end to the mounting flange (18), and at least one large diameter roller ring (40) mounted in the housing (30) in order to support the chute (32) with the ring (40). In order to increase the working life of the roller ring (40), at least one deformable linking element (70) is incorporated in the chain of rigid elements connecting the mounting flange (18) to the roller ring (40), in such a way that a rigid transmission of deformations of the mounting flange (18) to the roller ring (40) is largely prevented.

13 Claims, 4 Drawing Sheets

SHAFT FURNACE CHARGING DEVICE WITH ROTATING CHUTE

BACKGROUND OF THE INVENTION

The present invention relates to a shaft furnace charging device with rotating chute, comprising a supporting structure overhanging the shaft furnace, a batch hopper supported by this supporting structure, a drive housing for the chute which is connected in a sealed manner on one side to the batch hopper and on the other side to a mounting flange to be fixed rigidly to the shaft furnace, and at least one large diameter roller ring mounted in the housing in order to support said rotating chute.

Devices of this kind are described, for example, in the documents U.S. Pat. No. 3,693,812; U.S. Pat. No. 3,880,302; U.S. Pat. No. 3,81 4,403; U.S. Pat. No. 4.941,792 and U.S. Pat. No. 5,022,806. In these devices, the chute is suspended in a rotating cage, which is supported in the housing by means of a large diameter roller ring. The rotating cage defines the lower part of an axial flow channel connecting the batch hopper to the chute, and the large diameter roller ring surrounds this axial flow channel on the outside. The roller ring is designed to take up a large axial force and a large tilting moment. It comprises two coaxial rings connected by rolling elements. One of the two rings is fixed rigidly to the rotating cage, while the other ring is fixed rigidly to a supporting plate incorporated in the housing. The housing itself has a lower flange by means of which it is rigidly supported on the mounting flange fixed to the shaft furnace. The batch hopper is connected in a sealed manner to the housing, either rigidly or through the intermediary of an expansion joint. In short, in known devices, the weight of the chute is rigidly transmitted through the supporting plate and the housing to the mounting flange of the shaft furnace.

Many charging devices fitted with a suspension for the chute of this type have been in service on blast furnaces for more than 20 years. The large diameter roller ring is the most reliable method currently known for providing the rotating suspension for the chute in the housing.

Although this type of suspension for the rotating chute gives complete satisfaction, it should nevertheless be pointed out that the working life of the large diameter roller ring achieved in practice is substantially lower than the working life that could be expected according to calculations. This phenomenon has been known for some ten years, but one skilled in the art could not until now explain why in practice the roller ring has to be replaced sooner than predicted by calculations.

SUMMARY OF THE INVENTION

The basic problem addressed by the present invention is to increase the working life of the roller ring in a device of the type described in the preamble.

This problems finds its solution in at least one deformable linking element which is incorporated in the chain of rigid elements mechanically connecting the mounting flange, fixed rigidly to the shaft furnace, to the roller ring supporting the rotating chute, in such a way that a transmission of the deformations of said mounting flange to said roller ring is largely avoided.

A certain merit of the present invention is to have understood that the mounting flange fixed rigidly to the shaft furnace undergoes asymmetrical deformations which affect the working life of the roller ring. These deformations of the shaft furnace mounting flange are due on the one hand to the internal pressure prevailing in the shaft furnace and on the other hand to thermal expansions of the shaft furnace. Their asymmetry is probably due to the fact that the dome of the shaft furnace, to which the mounting flange is rigidly fixed, is a non-symmetrical structure which has, for example, several large local openings. Consequently, this dome is asymmetrically deformed under the combined effect of the internal pressure and the stresses of thermal origin. Moreover, this dome is not necessarily heated uniformly. In fact, the internal refractory lining may be thinner at certain places, which naturally produces an asymmetrical heating of the dome and hence, in the wall of the dome, an asymmetrical thermal stress field. In short, the dome undergoes asymmetrical deformations which necessarily create asymmetrical deformations of the mounting flange fixed to the dome.

In devices conforming to the present state of the art, these asymmetrical deformations of the mounting flange are transmitted through a chain of more or less rigid elements of the housing to the roller ring. The latter is consequently subjected to asymmetrical stress and strain fields which particularly affect its circular shape and flatness. The result of this is more rapid wear and hence a reduction in its working life, even in some cases a complete locking of the roller ring well before it has reached the end of its theoretically attainable working life.

In the device according to the invention, the deformable linking element incorporated in the rigid chain of elements connecting the mounting flange of the shaft furnace to the roller ring supporting the rotating chute absorbs a large proportion of the asymmetrical deformations of the mounting flange before these deformations can alter the geometry of the roller ring.

In a first advantageous embodiment, the deformable linking element is connected between a mounting plate and an outer jacket of the housing. The roller ring is fixed on to this mounting plate and the outer jacket of the housing is fixed directly to the mounting flange fixed to the shaft furnace. The deformations of this flange are mostly taken up by the deformable linking element. The absorption effect obtained is improved if its supporting plate is fitted with reinforcements giving it a much greater rigidity than that of the deformable element.

In a second advantageous embodiment of the invention, the deformable linking element is formed by a first expansion joint which connects the housing enclosing said roller ring in a sealed manner to the mounting flange of the furnace, while allowing relative displacements between the housing and the mounting flange of the shaft furnace. The housing is then supported either directly by a rigid supporting structure or by the batch hopper. The latter is directly or indirectly supported by a rigid supporting structure. Any rigid link between the mounting flange and the housing supporting the roller ring is therefore eliminated.

In a third advantageous embodiment, the deformable linking element is connected directly between a mounting plate incorporated in the housing and the roller ring. This solution naturally provides for the best protection of the roller ring, since the deformations of the supporting plate are themselves also absorbed.

In the first and third embodiments, the deformable linking element is preferably a ring whose annular wall defines a deformable loop.

In a fourth advantageous embodiment, the deformable linking element according to the invention directly supports the housing on the mounting flange. This solution differs from the first embodiment described above by the fact that the deformable linking element is capable of transmitting the weight of the housing/chute assembly directly to the mounting flange of the shaft furnace, whereas the expansion joint in the first embodiment is used solely to connect the housing in a sealed manner to the mounting flange of the shaft furnace and is in no way involved in taking up the weight of the housing/chute assembly.

Other advantages and characteristics of the invention will be derived from the detailed description of several preferred embodiments of the invention, and from representations of these preferred embodiments in the appended drawings.

DESCRIPTION OF THE PREFERRED EMBODIMENTS

Figure 1:
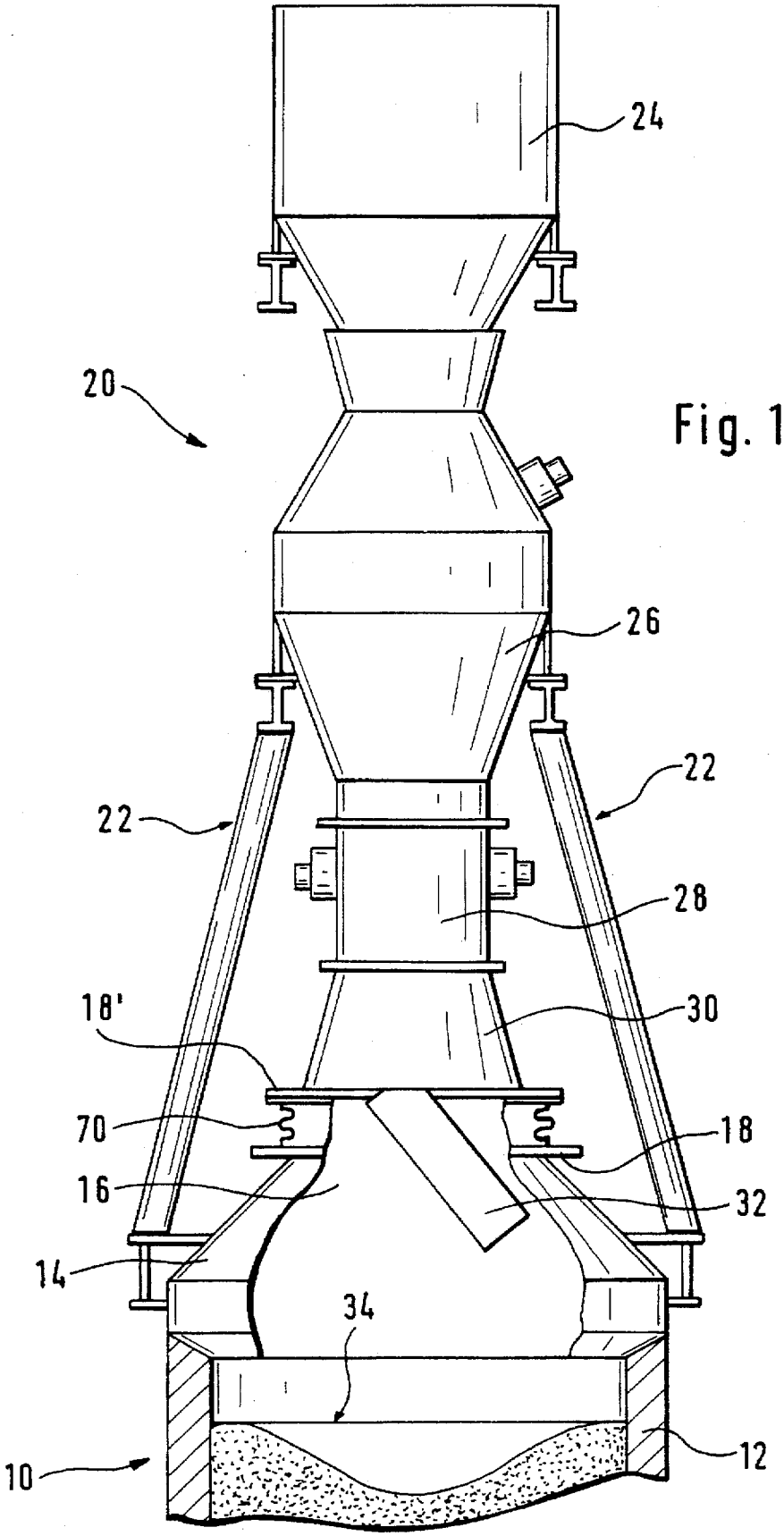
FIG. 1 is an elevation, partly drawn in the form of a cross-section, of a shaft furnace fitted with a first embodiment of the charging device with rotating chute according to the invention.

Referring first to FIG. 1, it will be noted that the reference number 10 is used to indicate a shaft furnace in its entirety. This may, for example, be a blast furnace, but it could also be another type of furnace which may be equipped with a rotating chute. The shaft furnace represented comprises a cylindrical body 12 and a terminal dome 14. This terminal dome 14 incorporates a charging opening 16 which is surrounded by a mounting flange 18, called in the rest of this document the mounting flange 18 of the shaft furnace 10. This mounting flange 18 is fixed rigidly to the dome 14 and is therefore exposed to all the deformations of the latter.

The reference number 20 is used to indicate a charging device with rotating chute in its entirety. The latter comprises, in the first place, a supporting structure 22 which overhangs the dome 14 of the shaft furnace and which rests, for example, on the body 12 of the shaft furnace. In some cases, the shaft furnace is, however, surrounded by an independent supporting structure, called a square tower, and the supporting structure 22 will be supported by this square tower. From the top to the bottom of FIG. 1, it is possible to distinguish:

- a fixed or rotating hopper 24, receiving the charging material;
- a batch hopper 26, which may be sealed at one end with respect to the hopper 24 and at the other end with respect to the furnace 10;
- a system 28 for weighing out the charging material, which is, most frequently, an independent element positioned below the batch hopper 26 but which, in order to simplify the terminology, is considered in the present description as forming part of the batch hopper 26;
- a drive housing 30; and
- a chute 32 which may rotate about the vertical axis of the shaft furnace 10 and whose angle of inclination with respect to the vertical may, most frequently, be varied.

The charging material flows from the batch hopper 26 through the weighing system 28 and the housing 30 on to the rotating chute 32. The latter distributes the charging material over the charge surface indicated by the reference number 34. The housing 30 encloses the means of suspension for the chute and the means for driving the latter. Different types of means for suspending and driving the chute 32 are described in detail in the documents cited in the introductory section of the present description. Using FIG. 3, only a brief description will be given here of one possible embodiment of these means for suspending and driving the chute.

Figure 3:
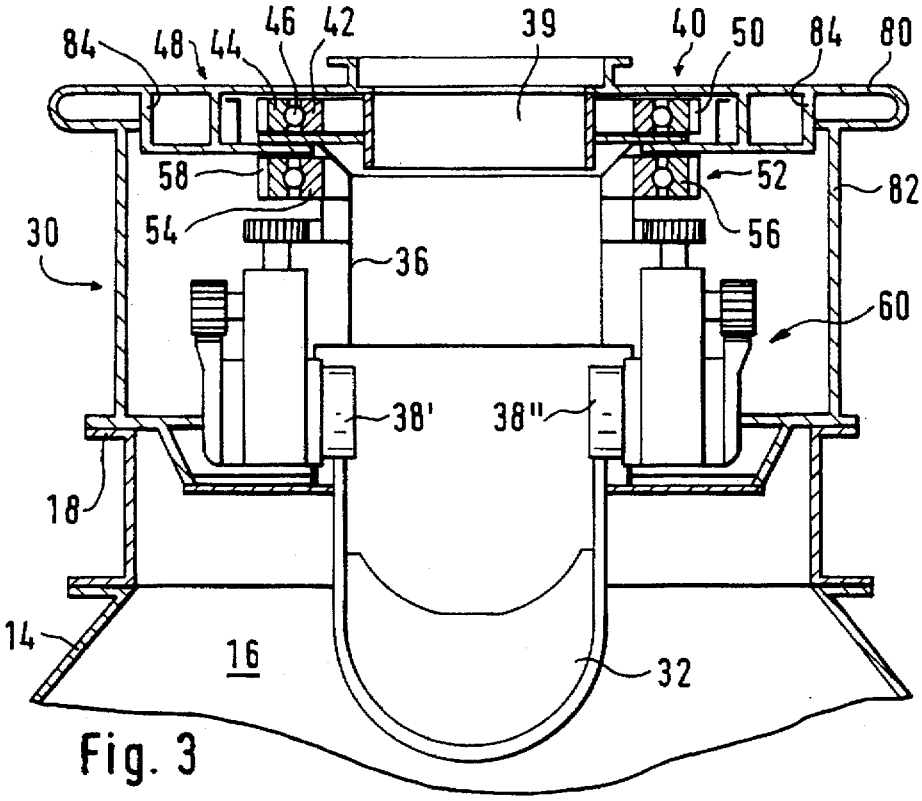
FIG. 3 represents a cross-section through a vertical plane of a drive housing for a rotating chute forming part of a second embodiment of the charging device with rotating chute according to the invention.

Thus, referring to FIG. 3, it can be seen that the chute 32 is supported by a rotating cage 36 through the intermediary of two lateral pivots 38' and 38". These lateral pivots 38' and 38" define a horizontal pivoting axis for the chute 32 about which the angle of inclination of the chute with respect to the vertical may be varied. The rotating cage 36 forms the lower part of a feed channel 39 which is coaxial with the axis of the furnace 10. This cage 36 is supported in the housing 30 by means of a large diameter roller ring 40 which surrounds the feed channel 39 and which defines the vertical rotation axis of the cage 36. This roller ring 40 is a tried and tested element for the rotatory suspension of the chute 32. It comprises an inner ring 42 and an outer ring 44 which are connected through rolling elements 46 in such a way that it can support large axial loads and large tilting moments. It is preferably the outer ring 44 which supports the rotating cage 36, whereas the inner ring 42 is fixed on to a supporting plate 48 of the housing 30. The outer ring 44 then supports a toothed gear 50 which interacts with a first pinion wheel (not shown) of a driving mechanism (not shown) for rotating the cage 36 and consequently the chute 32 about the axis of the shaft furnace 10.

A pivoting mechanism enables the angle of inclination of the chute 32 to be changed when it is rotating. This mechanism most frequently consists of a second large diameter roller ring 52, whose inner ring 54 is fixed to the supporting plate 48. The outer ring 56 of this second roller ring is equipped with a toothed gear 58 which interacts with a second pinion wheel (not shown) of a driving mechanism. This driving mechanism is capable of giving the outer ring 56 a rotational movement which can have a variable angular phase difference with respect to the rotational movement of the cage 36. A mechanism 60, connected mechanically between this outer ring 56 and at least one of the pivots 38', 38", enables this angular phase difference or phase shift to be converted into a pivoting of the chute about the two pivots 38', 38". Such pivoting mechanisms are described in more detail in the documents mentioned in the introduction of the present description.

According to the present invention, at least one deformable linking element is incorporated in the rigid chain of elements mechanically connecting the roller ring 40 supporting the rotating chute 32 to the mounting flange 18 of the shaft furnace, in such a way that a rigid transmission of deformations between the mounting flange 18 and the roller ring 40 is avoided. FIGS. 1 to 5 show several advantageous embodiments of the invention.

According to the embodiment of FIG. 1, an expansion joint 70 is connected between the flange 18 of the dome 14 and the mating flange 18' of the housing 30. This expansion joint 70, for example a metallic bellows expansion joint, guarantees the sealing between the housing 30 and the shaft furnace 10, while allowing a relative displacement of the two flanges 18 and 18'. The housing 30 is supported by the assembly comprising the batch hopper 26 and the weighing system 28. This assembly 26/28 is itself supported, as described above, by the supporting structure 22. The expansion joint 70 therefore has mainly to fulfil a sealing function and must not in any way support the weight of the assembly consisting of the housing 30 and the chute 32. It will thus be appreciated that in this embodiment, the dome 14 may be deformed asymmetrically, for example through the effect of an asymmetrical temperature field or of the internal pressures acting on the dome, without these deformations affecting the housing 30. The roller ring 40 incorporated in the housing 30 is consequently shielded from tensions induced by the asymmetrical deformations of the dome 14.

Figure 2:
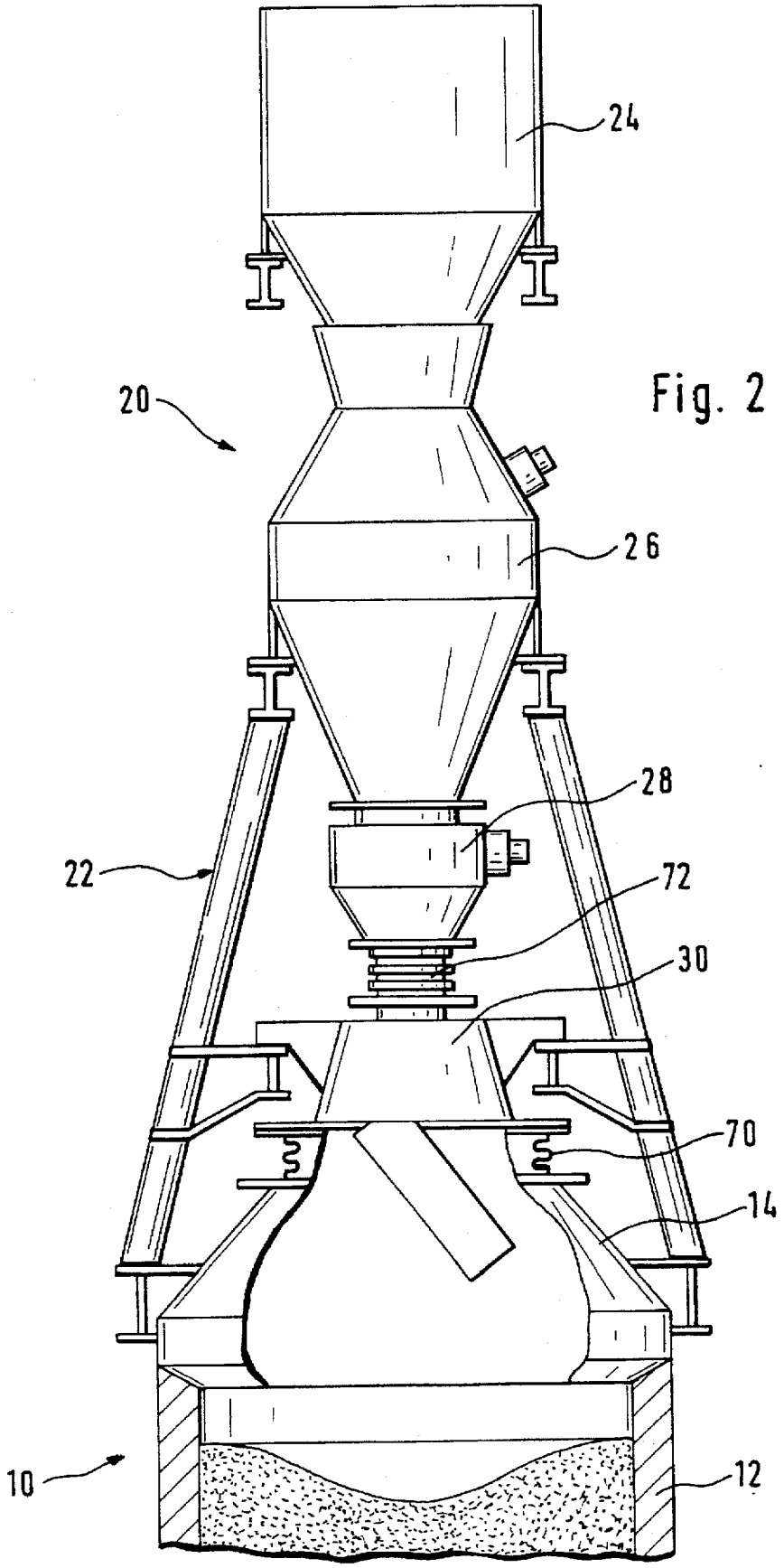
FIG. 2 represents, in a similar view, a variant of the embodiment of the device according to FIG. 1.

The device according to FIG. 2 is distinguished from the device of FIG. 1 by the fact that the housing 30 is directly supported by the supporting structure 22. A second expansion joint 72 is connected between the batch hopper 26/blocking system 28 assembly and the housing 30. This embodiment has the advantage that the housing 30, which is generally hotter than the batch hopper 26, 28, is able to expand almost freely at both ends. Moreover, this second expansion joint is recommended if a continuous weighing of the batch hopper is required using weighing cells incorporated in the supports of the hopper 26 on the supporting structure 22.

FIG. 3 shows a preferred embodiment of the invention in which the deformable linking element is incorporated in the housing 30. This deformable linking element comprises, more precisely, a deformable ring 80 connected between the supporting plate 48 of the housing and an outer jacket 82 of the housing 30. This modified housing 30 may be rigidly mounted on the mounting flange 18 of the shaft furnace 10. In effect, the deformations of this flange 18 affect the wall 82 of the housing 30, but have little or no effect on the supporting plate 48. It will be noted that the latter is advantageously reinforced by boxes 84 which increase its rigidity. In effect, the greater the rigidity of the supporting plate 48 compared with that of the deformable ring 80, the more the deformation of the outer jacket 82 will be taken up by the deformable ring. A high rigidity of the supporting plate 48 hence amplifies the absorption effect for deformations of the deformable ring 80 and thus guarantees that the supporting plate 48 is deformed neither in its plane nor in a direction perpendicular to this plane. In conclusion, a deformation of the dome 14 induces in the ring 42 of the roller ring 40, which is fixed on to the supporting plate 48, hardly any deformations affecting the circular shape and the flatness of this ring 42.

The deformable ring 80 is, for example, a ring having an open U-shaped section. One of the branches then forms a flange fixed, by welding for example, to the wall 82; while the other branch forms a flange fixed, by welding for example, to the supporting plate 48. The ring 80 is, as was seen above, dimensioned in such a way as to be much less rigid than the supporting plate 48. As a result of this, the deformations of the wall 82 produce a deformation of the U-shaped section of the ring 80 and do not affect the shape of the plate 48.

Figure 4:
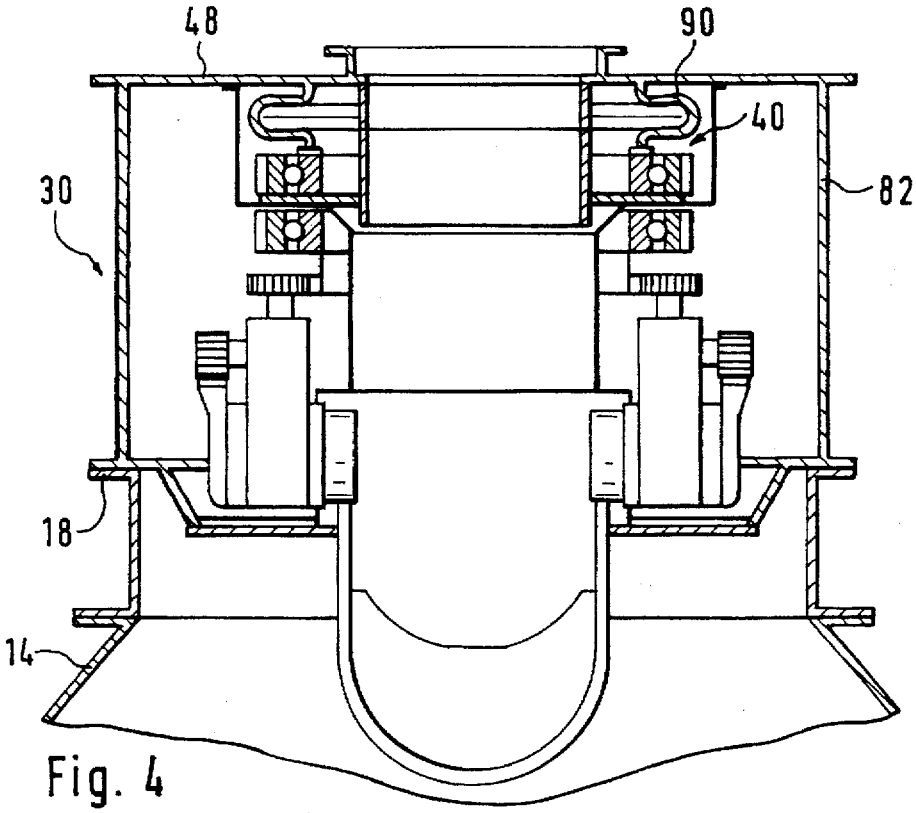
FIG. 4 represents a cross-section through a vertical plane of a drive housing for a rotating chute forming part of a third embodiment of the charging device with rotating chute according to the invention.

FIG. 4 also shows an embodiment in which the deformable linking element is incorporated in the housing 30. In this embodiment, the outer jacket of the housing 30 and the supporting plate 48 are assembled more or less rigidly. Between the supporting plate 48 and the roller ring 40, on the other hand, a deformable sleeve 90 is connected. The latter absorbs any possible deformations of the supporting plate 48 without transmitting appreciable stresses to the roller ring 40. The modified housing of FIG. 4 can itself also be mounted rigidly on the flange 18 of the dome 14.

Figure 5:
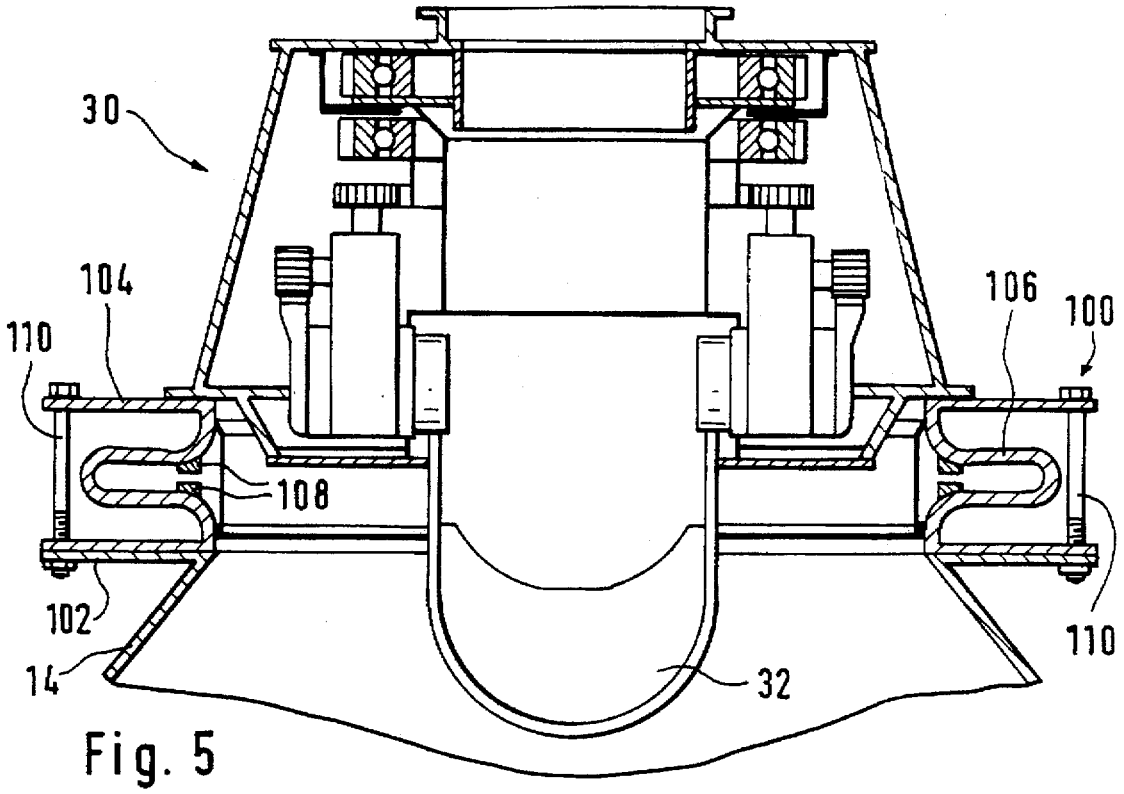
FIG. 5 represents a cross-section through a vertical plane of a drive housing for a rotating chute forming part of a fourth embodiment of the charging device with rotating chute according to the invention.

FIG. 5 shows an embodiment of a deformable linking element 100 which can be incorporated between the housing 30 and the dome 14 and which has the special feature of being able to transmit the weight of the housing 30/chute 32 assembly to the dome 14. The deformable element 100 comprises a lower flange 102, fixed to the dome 14, and a mounting flange 104 supporting the housing 30. The two flanges 102 and 104 are connected by a deformable metallic wall 106, which forms a loop open towards the inside. It will be noted that this loop preferably has the shape of a lyre. This metallic wall 106 is dimensioned in such a way that it is capable of transmitting the weight of the housing 30/chute 32 assembly from the mounting flange 104 to the lower flange 102, while allowing a relative horizontal and/or vertical displacement of the two flanges 102 and 104. However, in order to prevent the relative movements of the two flanges 102 and 104 from becoming too great, which could bring about a plastic deformation of the metallic wall 106, stops 108 and 110 have been provided. The stops 108 prevent too great a compression of the deformable element 100. The elements 110, on the other hand, prevent too great an extension and too great a relative horizontal displacement of the two flanges 102 and 104. It should be noted that the tie-rods 110 mainly have the aim of preventing too great an axial extension of the loop formed by the wall 106 through the effect of the internal pressure in the furnace (background effect).

Figure 6:
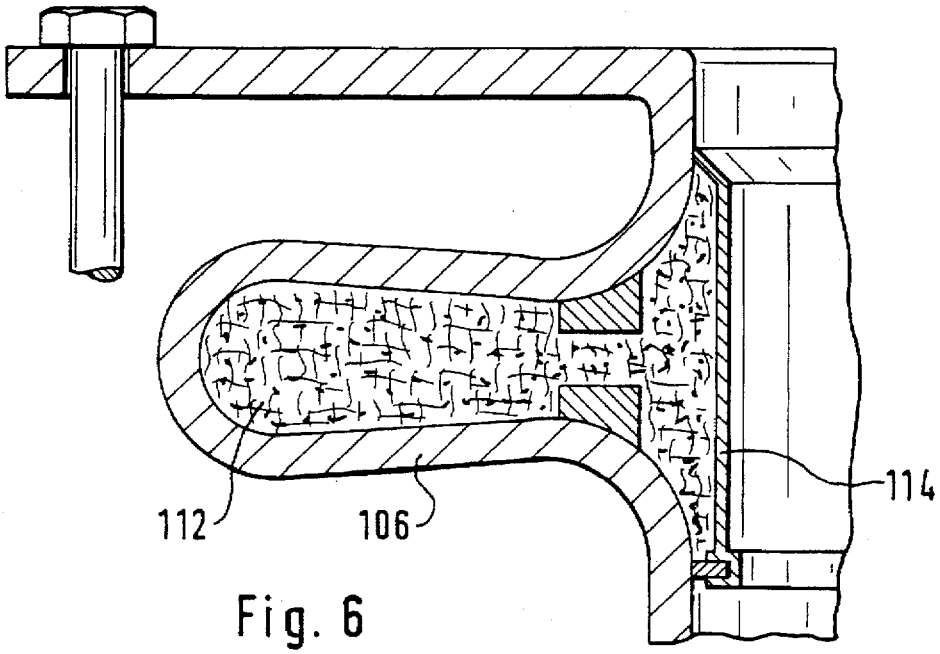
FIG. 6 represents a detail of a deformable linking element of FIG. 6.

FIG. 6 shows in detail a preferred embodiment of the deformable element 100. It can be seen that the loop formed by the wall 106 is completely filled with a material 112. This is an insulating and compressible material, a mineral wool for example. An annular screen 114 closes the opening of the loop, without upsetting the deformation of the latter. This embodiment of the deformable element 100 has the advantage that the deformable wall 106 is protected against excessive heating which would have harmful effects on its elastic properties, Moreover, filling the cavity in the interior of the loop with non-compressible materials which would upset the deformation of the wall 106 is ruled out.

It will be appreciated by one skilled in the art that two or more of the proposed embodiments may be combined in one charging device with rotating chute for a shaft furnace in order that they shall mutually support each other in their effects of absorbing the deformations of the dome 14. Thus, it is possible, for example, to combine the solution of FIG. 3 with the solution of FIGS. 2 or 5, or the solution of FIG. 4 with all the other solutions.

We claim:

1. Shaft furnace charging device with rotating chute, comprising a supporting structure (22) overhanging the shaft furnace (10), a mounting flange (18) to be fixed rigidly to the shaft furnace, a batch hopper (26, 28) supported by the supporting structure (22), a drive housing (30) for the chute (32) which is connected in a sealed manner at one end to the batch hopper (26, 28) and at the other end to said mounting flange (18), at least one large diameter roller ring (40) mounted in the housing (30) and supporting said rotating chute (32), said ring (40) being connected mechanically to said mounting flange (18) by a chain of rigid elements, characterised by at least one deformable linking element (70, 80, 90, 100) incorporated in said chain of rigid elements between said mounting flange (18) and said roller ring (40) supporting the rotating chute (32), in such a way that a rigid transmission of deformations of said mounting flange (18) to said roller ring (40) is largely avoided.

2. Device according to claim 1, characterised in that said housing (30) comprises an outer jacket (82) connected in a sealed manner between said mounting flange (18) and said batch hopper (26, 28) and a mounting plate (48) with high rigidity on which is mounted said roller ring (40), and in that said deformable linking element (80) supports said mounting plate (48) in said jacket (82).

3. Device according to claim 3, characterised in that said deformable linking element (80) has a U- haped section.

4. Device according to claim 2, characterised in that said mounting plate (48)includes reinforcements (84)increasing its rigidity.

5. Device according to claim 1, characterised in that said deformable linking element comprises a first expansion joint (70) which connects said housing (30) in a sealed manner to said mounting flange (18) while allowing relative displacements of the housing (30) and said mounting flange (18).

6. Device according to claim 5, characterised in that said batch hopper (26, 28) is supported by a rigid supporting structure (22) and in that said housing (30) is rigidly supported by said hopper.

7. Device according to claim 5, characterised in that said housing (30) is supported by said rigid supporting structure (22), and in that a second expansion joint (72) is connected between said housing (30) and said batch hopper (26, 28).

8. Device according to claim 1, characterised in that said roller ring (40) is directly supported in said housing (30) through the intermediary of said deformable linking element (90).

9. Device according to claim 8, characterised in that said deformable element (90) is a sleeve with deformable wall.

10. Device according to claim 1, characterised in that said housing (30) is supported through the intermediary of said deformable linking element (100) on said mounting flange (18).

11. Device according to claim 10, characterised in that said deformable linking element (100) comprises a lower mounting flange (102), an upper mounting flange (104), a deformable metallic wall (106) connecting in a sealed manner the lower flange (102) to the upper flange (104), said deformable metallic wall being dimensioned so as to support the weight of the chute (32)/housing (30) assembly, and stops (108, 110) limiting the relative displacements of the two flanges.

12. Device according to claim 12, characterised in that said deformable metallic wall (106) comprises a loop filled with an insulating compressible material (112).

13. Device according to claim 3, characterised in that said mounting plate (48) includes reinforcements (84) increasing its rigidity.

* * * * *

UNITED STATES PATENT AND TRADEMARK OFFICE

CERTIFICATE OF CORRECTION

PATENT NO. : 5,738,822
DATED : April 14, 1998
INVENTOR(S) : Lonardi et al.

It is certified that error appears in the above-identified patent and that said Letters Patent is hereby corrected as shown below:

Claim 1, line 16, delete "characterised by" and insert --wherein--.

Claim 12, line 1, delete "claim 12" and insert --claim 11--.

Signed and Sealed this

Fourteenth Day of July, 1998

Bruce Lehman

*Attest:*

BRUCE LEHMAN

*Attesting Officer*

*Commissioner of Patents and Trademarks*